United States Patent [19]

Grenier

[11] 4,391,109

[45] Jul. 5, 1983

[54] APPLIANCE DESIGNED FOR THE TREATMENT, PARTICULARLY IN A LIQUID, OF A PRODUCT LIKE LEATHER AND PROCEDURE FOR APPLYING THIS APPLIANCE

[75] Inventor: Yves Grenier, Le Verdin, France

[73] Assignee: R.I.A.T., Charavines, France

[21] Appl. No.: 235,478

[22] Filed: Feb. 18, 1981

[30] Foreign Application Priority Data

Feb. 18, 1980 [FR] France ..... 80 03516

[51] Int. Cl.[3] ..... C14C 1/00; D06F 21/00

[52] U.S. Cl. ..... 69/30; 69/31; 68/143; 68/145

[58] Field of Search ..... 69/29, 30, 31, 32; 68/143, 145, 210

[56] References Cited

U.S. PATENT DOCUMENTS 3,426,557 2/1969 Pillard ..... 69/30

3,919,865 11/1975 Glandfield ..... 69/30

4,122,692 10/1978 Dose ..... 69/30

*Primary Examiner*—Patrick D. Lawson

*Attorney, Agent, or Firm*—Beveridge, DeGrandi and Kline

[57] ABSTRACT

Appliance for the treatment, particularly in a liquid, of a product like leather, consisting of a perforated drum (1) containing compartments (9, 10, 11) separated by partitions (12, 13, 14) and connecting with the outside via openings (**9*a*, 9*b*, 9*c*) closed by doors, along with a tank (7) surrounding the drum (1) and provided with an opening (8), a fixing means enabling the drum (1) and the tank (7) to be fixed together in rotation when the opening (9*a*) of a compartment (9) is placed opposite the opening (8) in the tank (7) and a drive means (22) enabling the drum (1) and the tank (7) to be swung round jointly between a first position in which the opening (8) of the tank is in a top position and a second position in which the opening (8**) of the tank is placed on the side, the said first position corresponding to the treatment and loading of the product and the second position corresponding to its discharge.

17 Claims, 8 Drawing Figures

6
5
4
1b
1
7b
51
25
1a
III
II
2
21
20
7a
F
7
7c
24
22
23
3

APPLIANCE DESIGNED FOR THE TREATMENT, PARTICULARLY IN A LIQUID, OF A PRODUCT LIKE LEATHER AND PROCEDURE FOR APPLYING THIS APPLIANCE

This invention involves an appliance designed for the treatment, particularly in a liquid, of a product like leather and a procedure for applying this appliance.

At the present time appliances are known for treating leathers which consist of a fixed outer tank comprising an access opening on the side and a perforated rotary drum arranged inside so as to reduce the overall volume of the machine. The compartments are accessible through doors which are placed opposite the tank's side opening for loading and discharging the leathers.

With such appliances, the loading and unloading are carried out manually. It has been realized that these leather handling operations have many drawbacks. Thus the tanning operations make the leather very fluid, so that the manual loading and discharging of these leathers in known appliances are very difficult. These handling operations also require much time and are accompanied by the risk of damaging the leathers owing to their fragility.

The aim of the present invention is to remedy these shortcomings and thus ease the operations of loading and unloading a product like leathers in a treatment appliance, these operations being capable of being performed with virtually no manual intervention on the product.

The appliance designed for the treatment, in particular in a liquid, of a product like leathers, according to this invention, is of the type consisting of a perforated rotary drum arranged inside a tank which can be filled at least partially by the treatment liquid and fitted with an opening made in its peripheral wall, the said drum being mounted on a roughly horizontal shaft which runs from end to end of the said tank and which can be driven in rotation and comprising compartments separated by axial partitions extending roughly radially from its centre shaft to its peripheral envelope. In the type of appliance according to this invention, the product is loaded into each of the compartments in order to be treated by rotation of the drum, and discharged through the said tank opening and an opening made in the peripheral envelope of the drum, with the opening of each compartment being capable of being closed by a door fitted on the drum which can be locked in at least the closed position.

According to the present invention, the said tank is installed to pivot round the drum shaft. A fixing means enables the said drum and the said tank to be fixed together in rotation, in a detachable (temporary) manner, when the opening of one of the compartments is located opposite the tank opening for the purpose of loading and unloading the product in this compartment. A drive means acting on the said tank enables this tank to be pivoted between a first position in which its opening is located roughly in its top position and a second position in which the opening is placed on the side.

According to this invention, treatment of the product by rotation of the drum is performed when the opening of the said drum is in the said first position.

According to this invention, the product is loaded through the top, when the opening of the said tank is in the said first position and when the opening of the compartment being loaded is opposite the tank opening.

According to this invention the product is discharged laterally after, by means of the said drive means, the said tank and the said drum connected together by the said fixing means have been pivoted until the opening of the said tank has been placed in the said second position starting from the said first position.

Preferably, the opening of each compartment has an edge in the circumferential direction which is roughly contiguous with one of the partitions of this compartment, with the tank and the drum which is fixed to it by the said fixing means being rotated until the said partition contiguous to the opening occupies a position sloping downwards from the drum shaft so permitting the product to be discharged by gravity through the compartment opening and the tank opening.

According to this invention, the said door preferably comprises at least one flap which can be opened through the said tank opening and which forms the said fixing means fixing the drum and tank together, with a connecting means enabling the said flap to be fixed in a detachable manner to the said tank.

According to this invention, the said connecting means preferably comprises a support fixed to the tank and having a bearing surface against which the said flap bears when it is in the open position, hook-shaped elements fixed to the outer face of the flat and a locking means which works in conjunction with the said hook-shaped elements to hold the said flap against the said bearing surface.

According to this invention, the said locking means preferably comprises a bar mounted on levers pivoting on the said tank, at least one spring holding the said bar in the hook-shaped elements and a lever which can be operated manually enabling the said bar to be released from the hook-shaped elements by action against the said spring.

According to this invention, the said door preferably comprises a second flap, the said flap and this second flap being hinged on the opposite long edges of the compartment opening and these two flaps also being used, when they are in the open position, to guide the product when it is being loaded and discharged.

According to this invention, and in another embodiment variant, the said door of each drum compartment may comprise a flap which can be opened through the said tank opening and which is fitted on a long edge of the opening of the said compartment via a longitudinal hinge, the pin of which is fixed in rotation relative to the said flap.

A first longitudinal plunger mounted on the said tank on a first side of the drum and capable of acting on the said hinge pin enables the said hinge pin to be slid longitudinally and in a direction or first direction from an "in" position to an "out" position in which it acts with a means of rotation installed on the said tank on the other side or second side of the drum, with this means of rotation enabling the said hinge pin to be rotated to open or close the said flap. A second longitudinal plunger mounted on the said tank on the second side of the drum enables the said hinge pin to be slid longitudinally in the other direction or second direction from the said "out" position to the said "in" position. In addition a locking means enables the said flap to be held in the closed position, this means being actuated to lock the said flap in the closed position when the said hinge pin slides in the said second direction and in order to release the said flap when the said hinge pin slides in the said first direction. It may be noted that the said means of rotation and the said hinge pin, when they act together, can be designed so that they form the said means of fixing the drum and the tank together in rotation.

According to this other variant, the said door can comprise a second flap which may also be opened through the said tank opening and which is fitted on the other long edge of the opening of the said compartment through another longitudinal hinge, the pin of which is fixed in rotation to this second flap.

Another first longitudinal plunger, capable of acting on the said other hinge pin, fitted on the tank on the said first side of the drum enables the said other hinge pin to be slid longitudinally and in the said first direction from an "in" position to an "out" position where it acts with another means of rotation mounted on the said tank on the said second side of the drum, this means of rotation permitting the said other hinge pin to be rotated to open or close the said second flap. Another second longitudinal plunger fitted on the said tank on the said second side of the drum enables the said other hinge pin to be slid longitudinally and in the said second direction from its "out" position to its "in" position. In addition, another locking means enables the said second flap to be held in the closed position, this other means being actuated to lock the said second flap in the closed position when the said second pin slides in the said second direction and to release the said second flap when the said other hinge pin slides in the said first direction. It can be noted that the said other means of rotation and the said other hinge pin, when they act together, can also form the said means of fixing the drum to the tank in rotation.

In this other embodiment of the present invention, the said means of rotation and/or the said other means of rotation can consist of a rotary coupling sleeve comprising a longitudinal hole the end of which located on the drum side can take the end of the said hinge pin, these ends having corresponding cross-sections which enable the sleeve and the hinge pin to be engaged in rotation, a rotary drive means enabling the said sleeve to be rotated in one direction or the other to open or close the said flap and the said second plunger entering the said sleeve hole by its other end to act on the end of the said hinge pin in the said second direction.

According to this invention, the sleeve of the said means of rotation and the sleeve of the said other means of rotation preferably each comprise a radial arm and the drive means preferably consists of an actuating cylinder the rod of which is connected to the end of the arm of one sleeve and the body is connected to the end of the arm of the other sleeve in such a way that when this cylinder is actuated in one direction or the other, the sleeve of the said means of rotation and the sleeve of the said other means of rotation rotate in opposite directions to open or close the first flap and the second flap of the said door together.

According to the present invention, the said first plunger and the said other first plunger and respectively the said second plunger and the said other second plunger may be linked by a cross member and respectively by another cross member, with an actuating cylinder mounted on the tank being combined with each cross member to act on this cross member with the aim of moving the said combined plungers longitudinally in one direction or the other.

According to this other embodiment of this invention, the said locking means may consist of a first lever which is installed as a toggle system on the said drum and the end of one arm of which is fixed in translation to the said hinge pin and the end of the other arm of which carries or is fixed to a first locking finger which may act in conjunction with the side edge of the said flap located on the side of the said first plunger to lock it and a second are fixed in translation to the said hinge pin and carrying or fixed to a second locking pin which can engage with the transverse edge of the said flap located on the side of the said second plunger to lock it, so that when the said hinge pin is moved in the said first direction the said fingers move away and release the said flap and so that when the said hinge pin is moved in the said second direction, the said fingers move together and lock the said flaps by engaging respectively with the opposite side edges of the said flaps.

According to the present invention, and in the event of the said door consisting of two flaps, the said second lever preferably extends transversally and has one end fixed in translation to the said hinge pin and its other end fixed in translation to the said other hinge pin, this transverse lever carrying two fingers able to engage respectively with the transverse edge of the said flaps located on the side of the said second plungers.

According to this invention, the said flap or flaps of the said door preferably extend, when they are in their open position, roughly in planes passing through the drum axis.

According to this invention, the said means acting on the tank to pivot it round the drum shaft is preferably formed by at least one actuating cylinder arranged in a radial plane and acting on one tank end wall.

According to this invention, it is preferably planned to use a tank with an overall cylindrical shape.

According to this invention, the said tank is preferably mounted, at each of its axial ends, on a support by a sliding bearing, with a packing type seal forming leak-tight connection between the tank and the drum shaft and with the said support being adjustable in order to centre the said tank on the drum centre line.

This invention also covers a procedure for applying the said appliance.

According to the present invention, the procedure for utilizing the appliance is such that, for loading one of these compartments with products for treatment, the opening of this compartment which is to be loaded is placed opposite the opening made in the peripheral wall of the tank which is positioned roughly in its top position or in the said first position; the door closing the opening in this compartment is opened and the said product to be treated is loaded through the top.

According to this invention, the procedure for utilizing the appliance is such that, for unloading the treated product from one of these compartments, the opening of this compartment being unloaded is placed opposite the opening of the tank which is positioned roughly in its top position or the said first position; the door closing the opening in this compartment is opened, the drum and the tank are fixed together in rotation, and the tank and the drum fixed to it are swung round to the said second position in which the tank opening is placed on the side with the aim of side discharge of the treated product.

According to this invention, it is preferable to swing the tank and the drum fixed to it round to such a position that the treated product discharges from the compartment by gravity.

According to this invention, when the product is discharged from the compartment the tank and drum fixed to it are swung round in the other direction to again place the tank opening roughly in its top position which corresponds to the said first position; the compartment can then be loaded once again with the product to be treated.

The present invention will be better understood on study of examples of embodiments of an appliance designed for treating leather in a liquid, according to this invention, described in a non-restrictive way and illustrated by the drawing in which:

FIG. 1 schematically shows an outside elevation view of the appliance;

FIG. 2 schematically partly shows a section II—II and partly a section along F—F, of the appliance shown in FIG. 1, the appliance being in a leather loading position;

Figure 8:
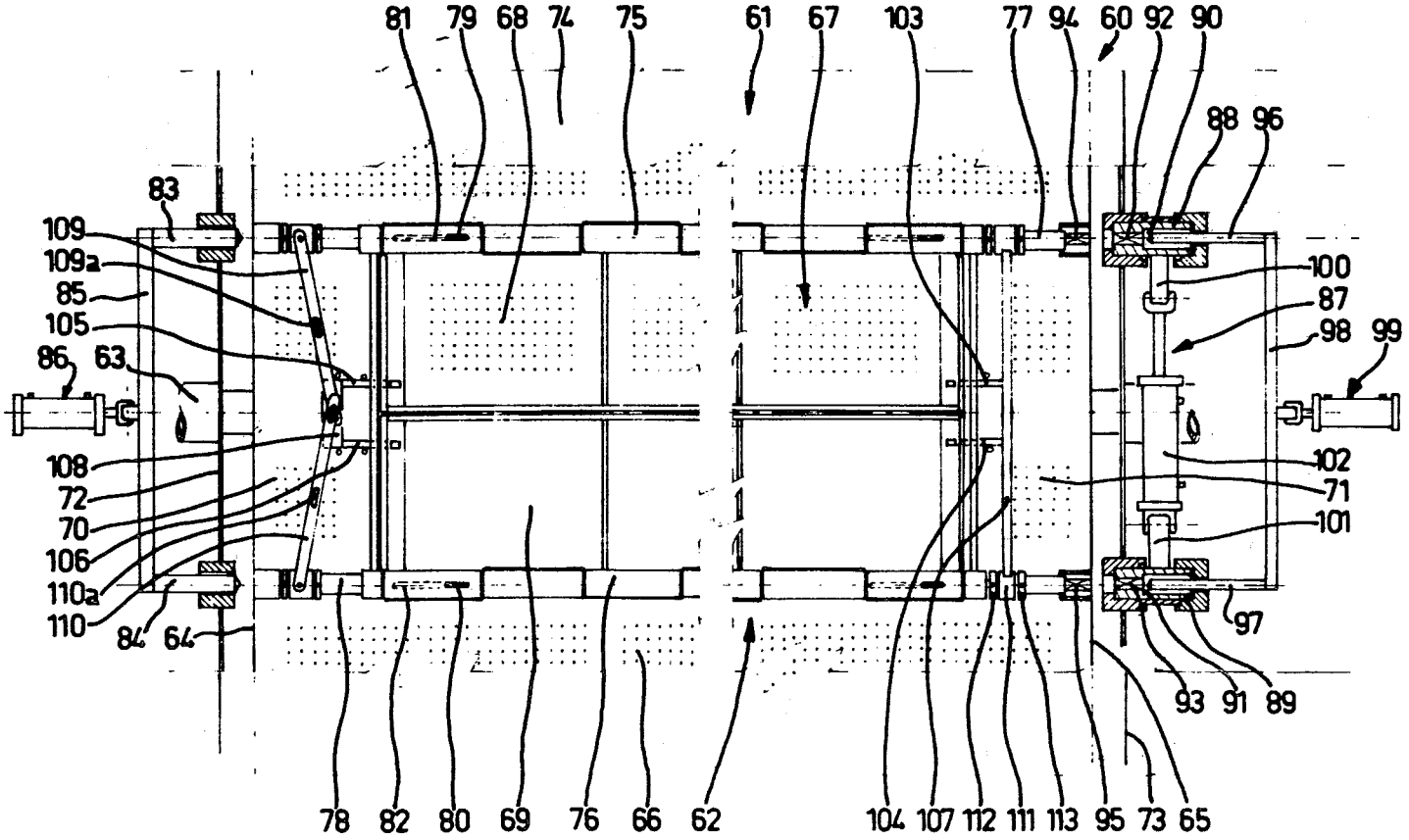

and FIG. 8 shows a part top view of an embodiment variant of the appliance in which its operation can be completely automatic, the doors being in the closed position.

It may be remarked that all the figures are not on the same scale so as to better understand the structure of the appliance.

Figure 1:
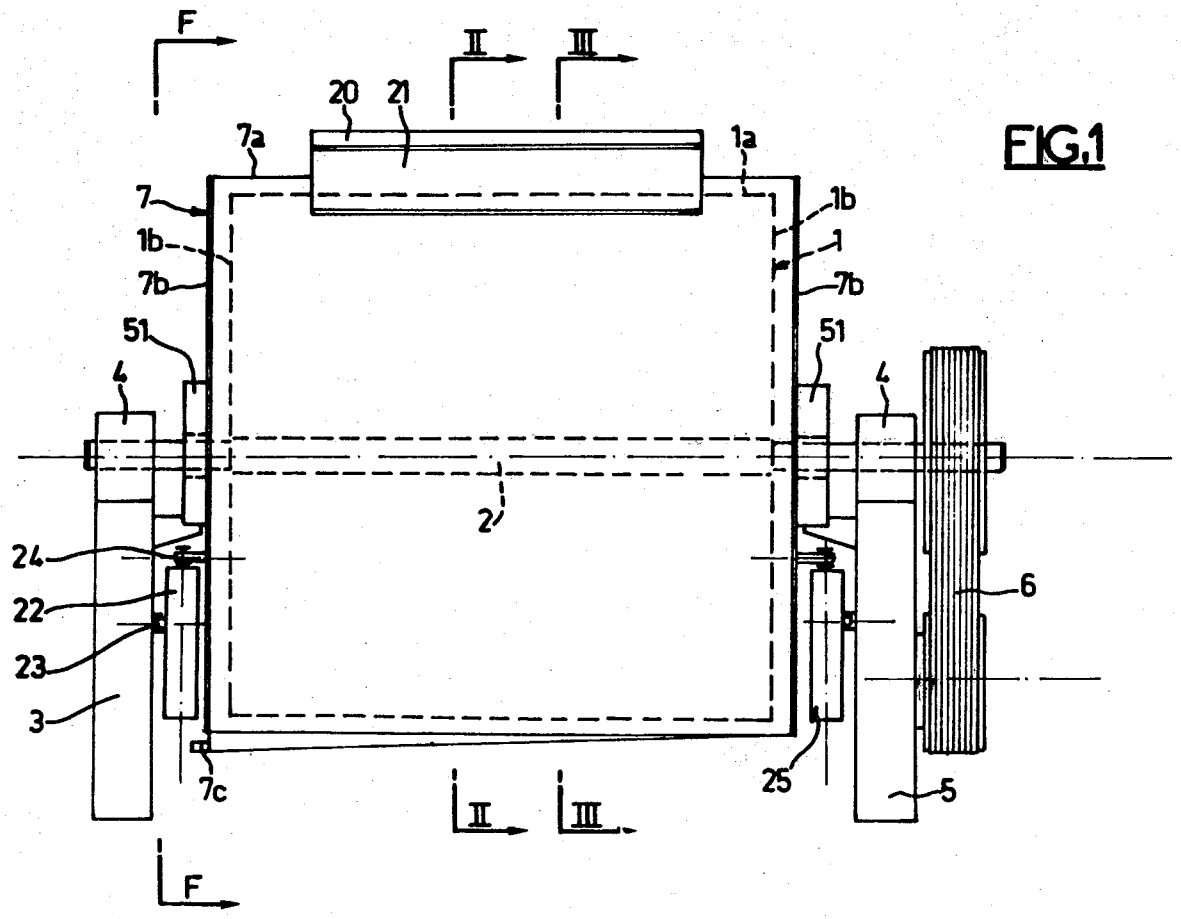
Figure 2:
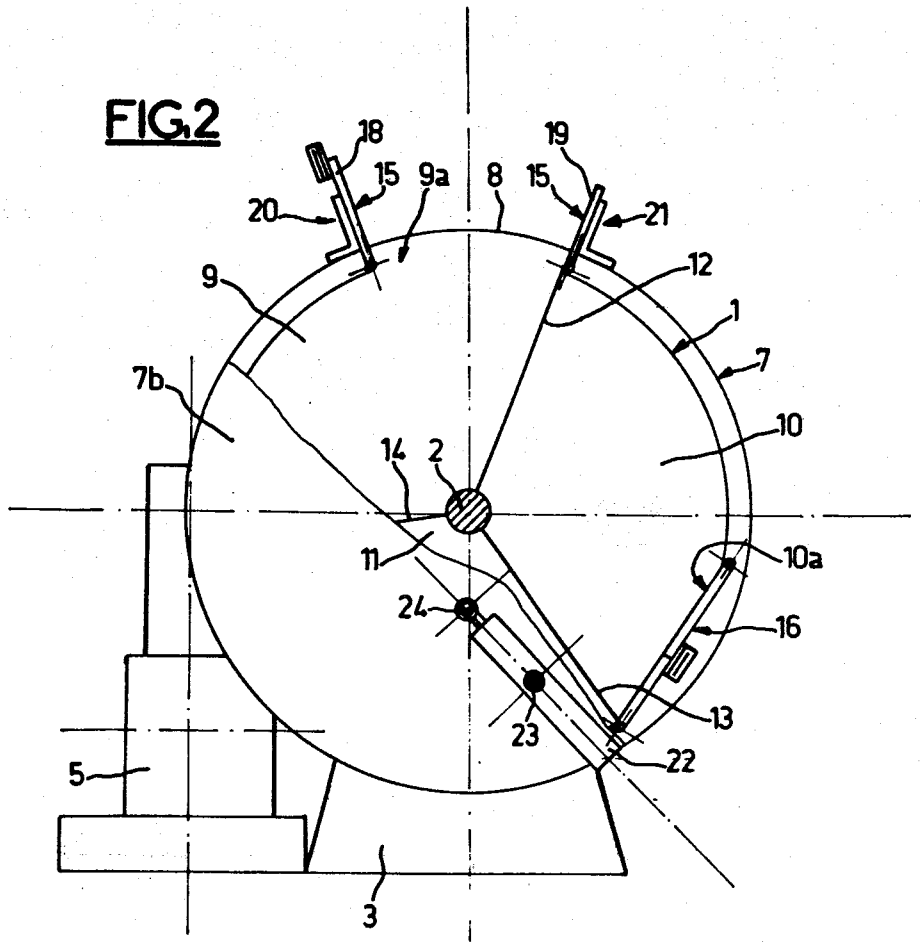
Figure 3:
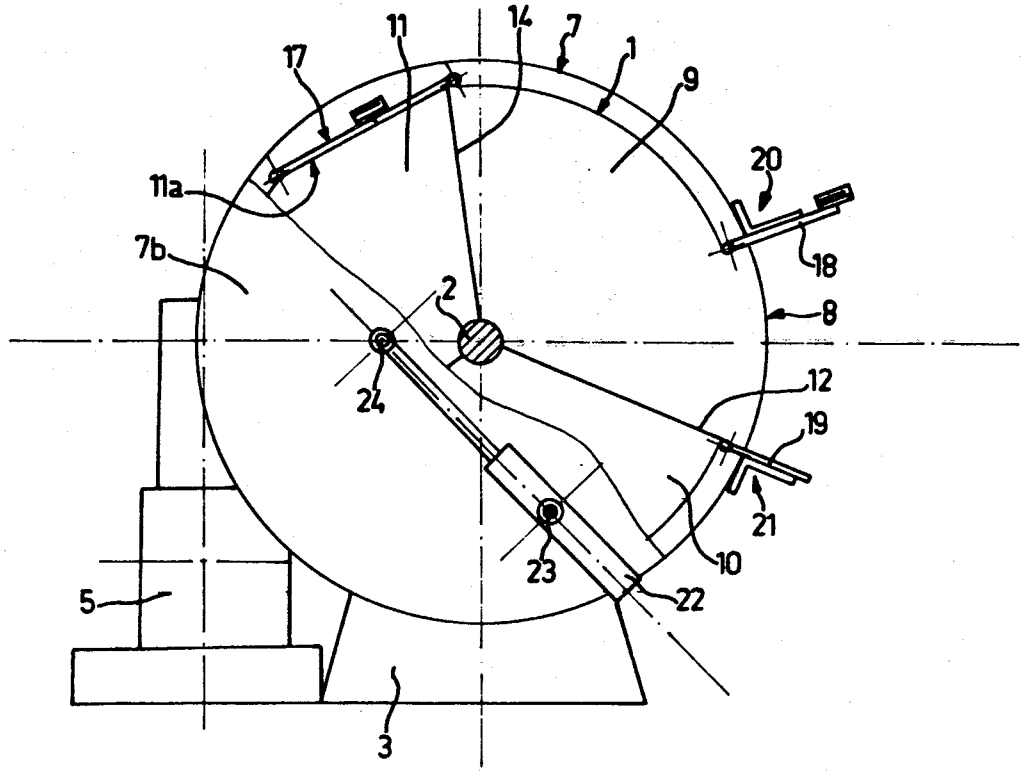
FIG. 3 is a view which corresponds to FIG. 2 and in which the appliance is in the leather discharge position.

As can be seen in FIGS. 1, 2 and 3, the appliance consists of a drum marked in a general way by the reference 1. This drum 1 is shaped like a cylinder and its peripheral envelope 1*a*, as well its end walls 1*b* are perforated.

The perforated drum 1 is mounted on a shaft 2 which passes through it and which is carried at its ends on supports 3 by means of bearings 4. As can be seen in FIG. 1, the shaft 2 is connected to the motor-reduction gear unit 5 via a set of belts 6.

The perforated drum 1 is surrounded by a cylindrical tank marked in a general way by refernce 7 which has a peripheral wall 7*a* and axial end walls 7*b* which are placed between the ends 1*b* of the perforated drum 1 and the supports 3.

Figure 7:
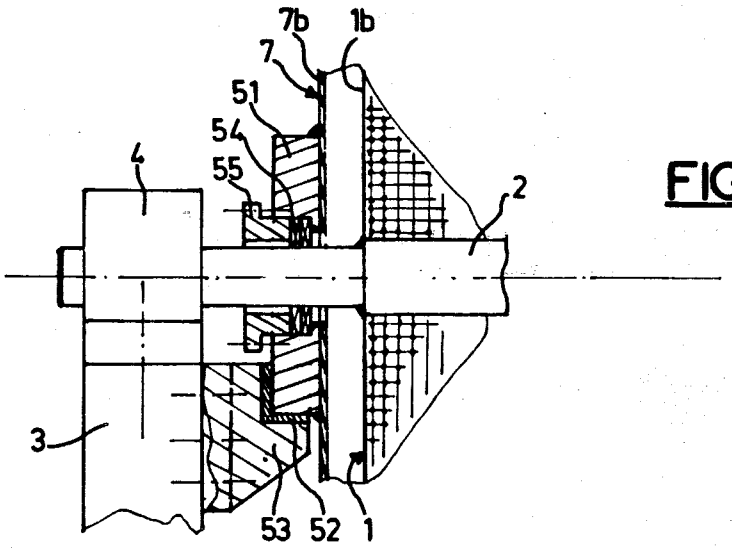
FIG. 7 shows a section view of the assembly of the tank round the drum shaft.

The tank 7 is mounted to swivel round the drum axis as will be seen in connection with FIG. 7.

Figure 4:
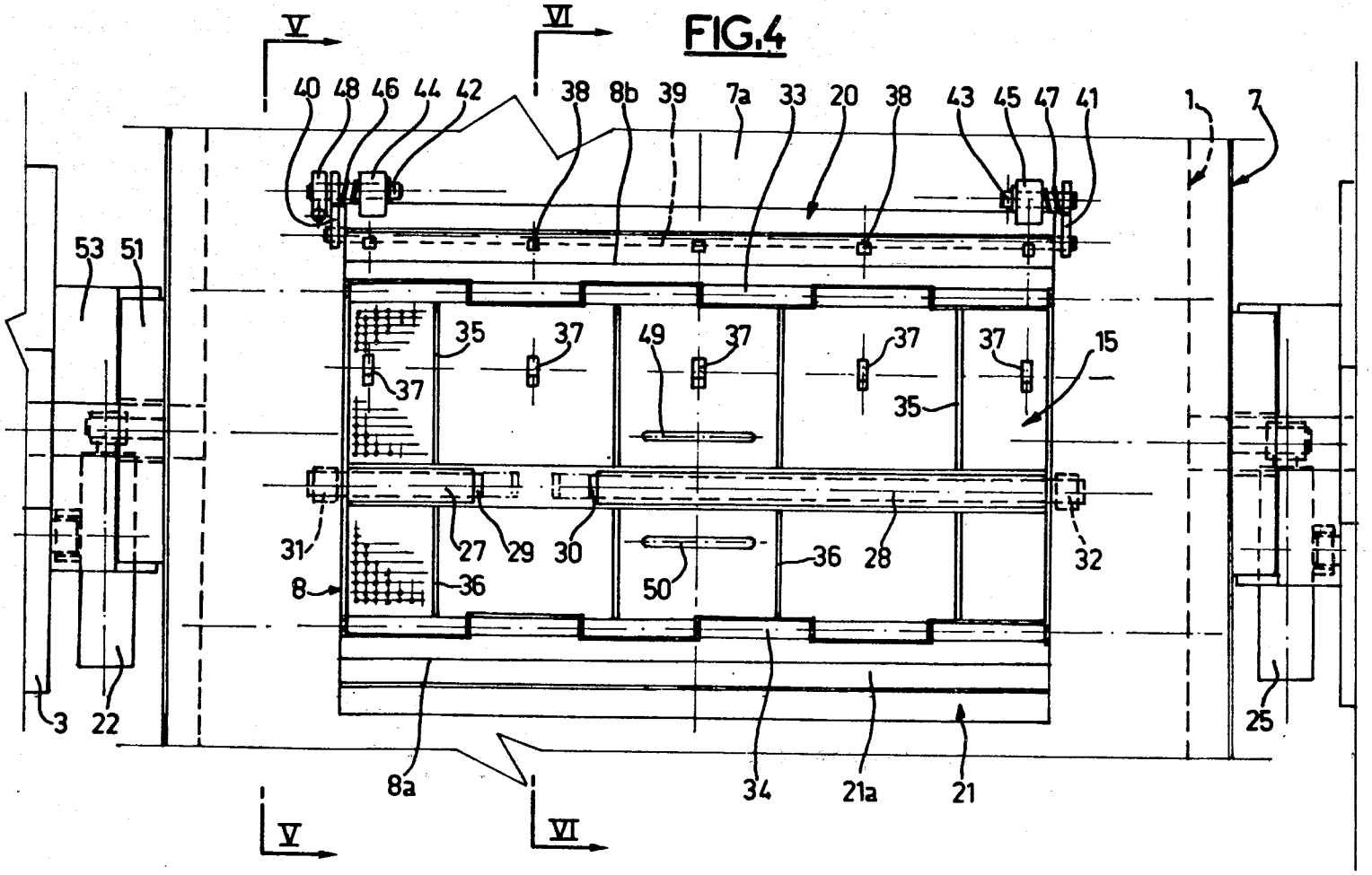
FIG. 4 shows a more detailed part top view of the appliance according to FIG. 1.

The tank 7 has in its peripheral wall 7*a* an opening 8 which is clearly visible in FIG. 4. This opening 8 is roughly rectangular and has two longitudinal edges 8*a* and 8*b*. In FIG. 1, the opening 8 is at the top. The tank 7 comprises in its bottom section a liquid outlet orifice 7*c* and also comprises a liquid feed orifice which has not been shown. These orifices are connected to flexible pipes which are not shown.

As can be seen in FIGS. 2 and 3, the inside of the drum 1 is divided into three compartments 9, 10 and 11 which are separated by partitions 12, 13 and 14 which extend axially between the end walls 1*b* on the one hand and radially between the shaft 2 and the envelope 1*a* on the other. These partitions 12, 13 and 14 are perforated and are roughly 120° apart.

The compartments 9, 10 and 11 are connected to the outside respectively by openings 9*a*, 10*a* and 11*a* made in the envelope 1*a* of the drum 1; these openings are roughly rectangular and have two longitudinal edges one of which is next to one of the separating partitions.

The openings 9*a*, 10*a* and 11*a* can be closed respectively by the doors 15, 16 and 17. These doors are formed by two flaps which are hinged on the longitudinal edges of the corresponding opening and are produced in the same way. For example, door 15 is formed by flaps 18 and 19, flap 19 being hinged on the edge of opening 9*a* which is contiguous to partition 12. Flaps 18 and 19 are so designed that they can be opened through the opening 8 in the tank 7 when the opening 9*a* of compartment 9 is placed opposite the opening 8 of the tank 7 and that, when they are open as shown in FIGS. 2 and 3, they take up a roughly radial position and lean respectively against supports 20 and 21 which have radial sections 20*a* and 21*a*, which are fastened on the outside wall 7*a* of the tank 7 and which extend along the edges 8*b* and 8*a* of the opening 8. It may be noted that when the flap 19 of the door 15 is in the open position, i.e. it is leaning on the support 21, it is roughly in line with partition 12.

In the open position, as shown in FIGS. 2 and 3, the flap 18 of the door 15 can be held against the support 20 by means of an assembly which will be described later in connection with FIGS. 4, 5 and 6.

The flaps of doors 15, 16 and 17 can be held in the closed position by means of a system of bolts as will be seen later.

Parallel to the end wall 7*b* of the tank 7 and placed between this end wall and the support 3, there is an actuating cylinder 22 which is hinged on support 3 by a pivot 23 with its pin parallel to the shaft 2, hinges 23 and 24 being shown schematically. Hinges 23 and 24 are arranged so that, when the cylinder 22 is actuated, the tank 7 can swing round the shaft 2 so that its opening 8 can take up two positions which correspond respectively to a first position in which the opening 8 is in a top position as shown in FIG. 2 and to a second position in which the opening 8 is placed on the side as shown in FIG. 3, with the tank 7 swinging through roughly 90°. Acting on the other end wall 7*b* of the tank 7 another cylinder 25 is also provided roughly parallel to the cylinder 24.

Figure 5:
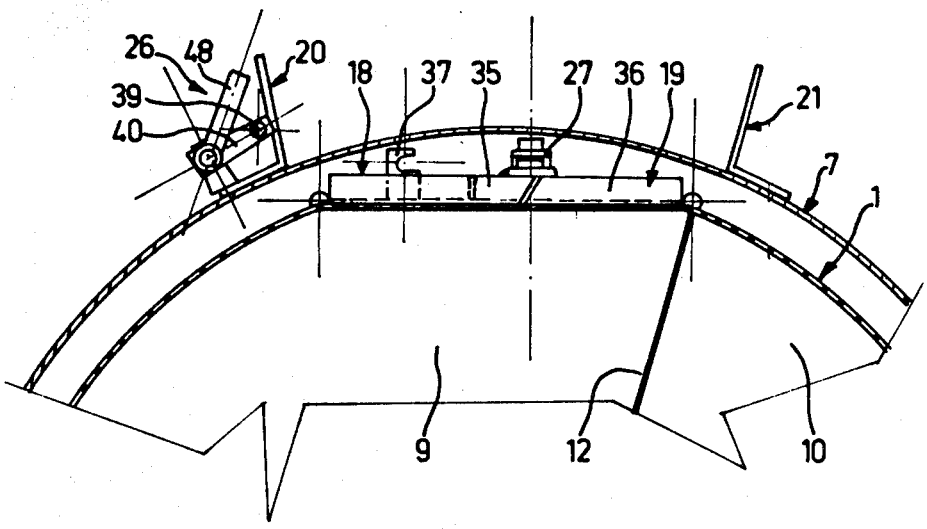
FIG. 5 shows a part section view along V—V of FIG. 4, with the door in the closed position.
Figure 6:
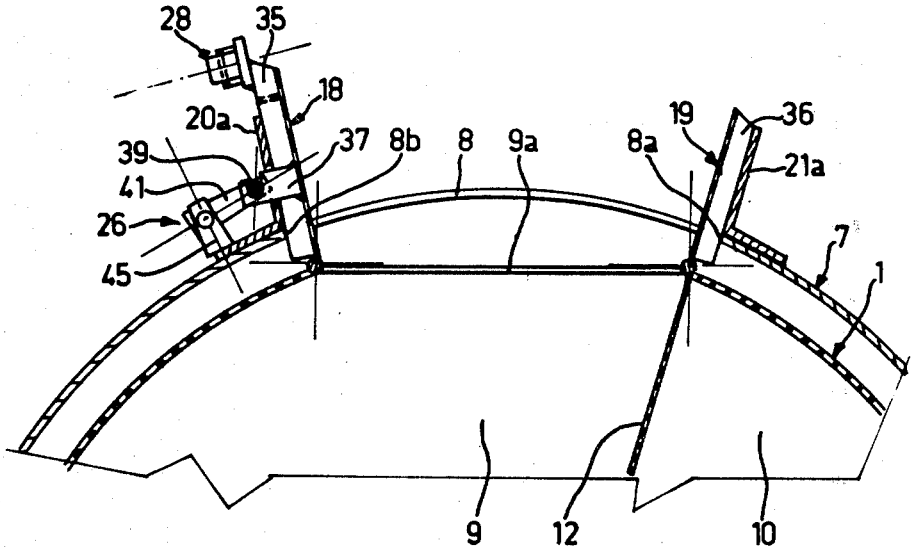
FIG. 6 shows a part section view along VI—VI of FIG. 4, with the door in the open position.

With reference to FIGS. 4, 5 and 6 we shall describe the construction of the doors and the means of assembling a door flap with the peripheral tank wall, this flap forming the means of fixing the drum 1 and the tank 7 together in rotation. Door 15 will be taken as an example. In FIGS. 4 and 5, door 15, which consists of flaps 18 and 19 is shown in the closed position whilst in FIG. 6 flaps 18 and 19 are in the open position through the opening 8 in the tank 7 and lean against the supports 20 and 21, flap 18 being joined to the tank 7 by the connecting means marked in a general way with the reference 26 whilst flap 19 is held by its own weight.

Flaps 18 and 19, which are respectively hinged on the opposite longitudinal edges of the opening 9*a* by the hinges 33 and 34, are held closed by the bolts 27 and 28 which are fixed on the longitudinal edge of flap 18 parallel to the hinge 33 and which overlap the adjacent longitudinal edge of flap 19. The latches 29 and 30 of the bolts 27 and 28 can be moved longitudinally in opposite directions to engage with the strikers 31 and 32 which are fixed on opposite circumferential edges of the opening 9*a* in the drum 1.

The flaps 18 and 19, which are perforated, are fitted respectively with cross stiffeners 35 and 36 which lean against the supports 20 and 21 when the flaps are open.

On the top face of the flap 18 five hook-shaped elements 37 are placed transversally and on the same longitudinal line, which elements run perpendicularly to the flap 18 beyond the upper surface of the stiffeners 35 to pass through perforations 38 which are made in the radial part 20*a* of the support 20 when the flap 18 is in the open position.

The connecting means 26 comprises a longitudinal bar 39 the ends of which are fixed on the levers 40 and 41 which are also hinged on shafts 42 and 43 which extend longways and which are mounted on the supports 44 and 45 fixed to the peripheral wall of the tank 7. The levers 40 and 41 extend, in the same direction, in the circumferential direction of the tank 7. The bar 39, by rotating round the shafts 42 and 43, can engage with the hook-shaped elements 37 in such a manner as to keep the flap 18 in contact with the support 20. As can be seen in FIG. 4, the torsion springs 46 and 47 located round shafts 42 and 43 act to hold the bar 39 engaged with the hook-shaped elements 37.

A lever 48 fixed to shaft 42 enables, by manual operation, bar 39 to be disengaged from the hook-shaped elements by working against the torsion springs 46 and 47, both when the flap 18 is fastened against the support 20 and when it is released.

As can be seen in FIG. 4, the flaps 18 and 19 of the door 15 are respectively provided with a handle 49 and a handle 50 which enable these flaps to be operated.

In reference to FIG. 7, we shall describe how the tank 7 is supported. Only one end of the shaft 2 has been shown in this figure since the assembly of the other end of the shaft 2 is the same.

A ring 51 surrounding the shaft 2 and a certain distance away is fitted on the end wall 7*b* of the tank 7. This ring 51 is carried by a bearing liner 52 which has an L-shaped axial cross-section so simultaneously forming an axial thrust bearing and which surrounds only the lower part of the ring 51. The liner 52 is installed in a bracket 53 which may be fixed to the support 3. A screw and nut type assembly, for example, allows the bracket 53 to be adjusted for height so as to suitably align the ring 51, and therefore the tank 7, with the shaft 2.

In order to provide the necessary seal between the tank 7 and the shaft 2, a packing type seal 54 is placed between the ring 51 and the shaft 2; this packing can be compressed by a gland follower screwed into the ring 51.

We shall now describe how the appliance described above operates referring mainly to FIGS. 2 and 3.

The position of the tank 7 shown in FIG. 2, in which its opening 8 is in a top position, is the one its occupies during treatment of the product by rotation of the drum 1, with the compartment doors being closed and locked by bolts 27 and 28. This position is also the one in which the door of one of the compartments is open for loading or discharging the leather in this compartment.

Thus, when it is required to introduce the leather to be treated into compartment 9, for example, the drum 1 is rotated to bring the opening 9*a* of compartment 9 opposite the opening 8 in the tank 7. The door 15 is unlocked and the flaps 18 and 19 are opened through the opening 8 in the tank 7 in such a way that they lean against the supports 20 and 21. Owing to the position of the support 21, the flap 19 remains leaning against this support by virtue of its own weight. In order to set up the rotational link between the drum 1 and the tank 7, the lever 48 is operated manually so as to move away the bar 39; flap 18 is pressed against the support 20 and the lever 48 is released. By means of the springs 46 and 47 the bar 39 engages with the hook-shaped elements 37 which pass through the radial section 20*a* of the support 20 via the orifices 38.

In the open position which is shown in FIG. 2, compartment 9 can be top loaded, for example by tipping the leather to be treated from a skip or a conveyor, using the flaps 18 and 19 which converge towards the inside of the compartment 9 as guide surfaces. When compartment 9 is loaded flap 19 is closed again; flap 18 is released by operation of lever 48 using the connecting means 26, this flap is closed and the door is locked by bolts 27 and 28.

It can be pointed out that when loading a compartment it is not inevitably necessary to lock the flap 18 to the support 20.

After treatment, if it is wished to discharge the contents of the compartment 9, the same operations are carried out first of all as for loading in order to bring the flaps 18 and 19 into the open position, with flap 18 being attached to the support 20 by the connecting means 26 in order to fix the drum 1 and the tank 7 together. The appliance is therefore in the position shown in FIGS. 2 and 6. Then, by means of the cylinders 22 and 25, the tank is swung round in a direction going from flap 18 to flap 19 until it has been brought into the position shown in FIG. 3, in which position the partition 12 and the flap 19 are sloping down from the centre line or shaft 2 of the drum 1, so that the contents of compartment 9 can slide over the partition 12 and the flap 19 to be discharged towards a skip.

When discharge is over, the tank 7 and the drum 1 fixed to it by flap 18 are swung round the other way by means of cylinders 22 and 25 to the corresponding position in FIG. 2 in which the opening 8 occupies a top position. The compartment 9 with its contents emptied is then in a position in which it can again be loaded from the top.

The operations which have just been described with reference to compartment 9 are performed in the same way with reference to compartments 10 and 11.

As it may already have been noticed, the embodiment of the treatment appliance described in particular with reference to FIGS. 4, 5 and 6 requires manual operations, notably to open and close the flaps of the door of each compartment. Referring to FIG. 8 we shall now describe a treatment appliance which comprises means enabling all manual operations to be eliminated for opening and closing the drum compartment doors and capable of being fitted in the same way.

The treatment appliance shown in FIG. 8 and marked in a general way by reference 60 consists, like the treatment appliance already described, of a cylindrical tank 61 and inside this tank a perforated rotary drum 62, with the tank 61 and the drum 62 being able to pivot or rotate round a shaft 63.

The drum 62 consists of two radial end walls 64 and 65 and a cylindrical wall 66 in which one opening per compartment is made. In FIG. 8, the drum 62 is placed in a position relative to the tank 61 such that the door marked in a general way by the reference 67, which consists of two flaps 68 and 69 hinged on the opposite longitudinal edges of the peripheral opening of the compartment involved, is in a position in which it can be opened. As can be seen in FIG. 8, the door 67 which covers the opening of the compartment combined with it is shorter than the drum 62, with the peripheral wall 66 of the drum 62 having end sections 70 and 71 which extend between the transverse edges of the opening blocked by the door 67 and the end walls 64 and 65.

The tank 61 consists of two radial end walls 72 and 73 located at a distance from the end walls 64 and 65 of the drum 62 and a cylindrical wall 74 surrounding the peripheral wall 66 of the drum 62 and some distance from it. The peripheral wall 74 of the tank 61 comprises an opening which cannot be seen if FIG. 8 through which the flaps 68 and 69 of the door 67 can open and be placed, in the open position, radially.

The flaps 68 and 69 of the door 67 are fitted on the longitudinal edges of the opening of the compartment involved by means of longitudinal hinges 75 and 76 the hinge pins of which 77 and 78 extend throughout the length of the drum 62 outside its cylindrical wall 66 and are shown in an "in" position in which they do not extend beyond the end walls 64 and 65. The hinge pins 77 and 78 are fixed in rotation to the flaps 68 and 69 by means of two pins 79 and 80 which are fixed to the parts of the hinges attached to the flapssurrounding the hinge pins and which pass through longitudinal grooves 81 and 82 provided in the hinge pins allowing the hinge pins 77 and 78 to slide along their axis relative to the flaps.

Placed on either side of the drum 62, i.e. on the side of its end wall 64, longitudinal plungers 83 and 84 are fitted on the tank 61 and they go through the end wall 72 of the tank 61. The longitudinal plungers 83 and 84 are spaced the same distance apart as the hinge pins 77 and 78 and are located in line with these hinge pins. Outside the tank 61, the plungers 83 and 84 are connected by a cross member 85. A cylinder 86, the body of which is fastened onto the tank and rod end of which is connected to the middle of the cross member 85 makes it possible, when it is actuated, to move the plungers 83 and 84 horizontally. The stroke of the cylinder 86 is such that in one extreme position the longitudinal plungers 83 and 84 are outside the wall 64 of the drum 62 and when they move to their other extreme position they meet the end of the hinge pins 77 and 78 so making them slide in a direction which takes them away from the end wall 64 to a position in which their ends 94 and 95 go beyond the end wall 65 of the drum 62.

Located on the other side of the drum 62, i.e. on the end wall 65 side, a means of rotation 87 is provided which is installed on the end wall 73 of the tank 61 and is capable of rotating the hinge pins 77 and 78 to open or close the flaps 68 and 69 after these hinge pins have been moved by the longitudinal plungers 83 and 84 to their "out" position.

The means of rotation 87 consists of two sleeve couplings 88 and 89 installed on the end wall 73 of the tank 61 in such a manner as to be capable of rotating round axes lined up with the axes of the hinge pins 77 and 78, the spacing between the axes of these sleeves being roughly equal to spacing between the hinge pins 77 and 78.

The sleeve couplings 88 and 89 comprise longitudinal holes 90 and 91 the ends 92 and 93 of which located on the side of the hinge pins 77 and 78 have a square cross-section, with the ends 94 and 95 of the hinge pins 77 and 78 having a corresponding square cross-section so that they can be engaged by the ends 92 and 93 of the holes 90 and 91 in the sleeves 88 and 89 when the hinge pins 77 and 78 are slid by means of the plungers 83 and 84 to their "out" position.

Longitudinal plungers 96 and 97 which extend partially into the holes 90 and 91 in the sleeves 88 and 89 from the end opposite to the square-section ends 92 and 93 are connected by a cross member 98. A cylinder 99 whose body is fastened to the tank 61 and whose rod end is connected to roughly the middle of the cross member 99 enables the plungers 96 and 97 to be moved longitudinally in the direction of the hinge pins 77 and 78, the stroke of the cylinder 99 being such as to allow the plungers 96 and 97 to be moved from a position in which they are outside the square ends 92 and 93 of the sleeves 88 and 89 to a position in which they reposition the hinge pins 77 and 78 in their "in" position shown in FIG. 8.

The sleeves 88 and 89 carry two radial arms 100 and 101 the ends of which are connected by pivots respectively to the rod and to the body of a cylinder 102. The arms 100 and 101 are placed so that, when the cylinder 102 is actuated in one direction or the other, the sleeves 88 and 89 rotate in the opposite direction.

As can be seen in FIG. 8, the fingers 103 and 104 and fingers 105 and 106 are designed to lock the flaps 68 and 69 of the door 67 in the closed position, with fingers 103 and 104 engaging with the transverse edges of the flaps 68 and 69 located on the side of section 71 of the drum 62 and fingers 105 and 106 engaging with the transverse edges of the flaps 68 and 69 located on the side of section 70 of the drum 62. Fingers 103 and 104 are fixed to a lever 107 which extends above section 71 of the drum 62 with its ends fixed in translation to the hinge pins 77 and 78. Fingers 105 and 106 are connected by a cross member 108 and are installed to be movable longitudinally above section 70 of the drum 62. In order to move fingers 105 and 106 two toggle levers 109 and 110 are provided which are installed to pivot in the middle at 109*a* and 110*a* on section 70 of the drum 62 with one end being connected to the cross member 108 and the other end fixed in translation to one of the hinge pins 77 and 78 by a pivot. The ends of levers 107, 109 and 110 are fixed in translation to the hinge pins 77 and 78 by means of bushes 111 fixed or connected to these ends; these bushes surround the hinge pins 77 and 78 and are inserted between two stops 112 and 113 which are fixed to these hinge pins. Thus, fingers 103 and 104 can move in the same direction as the hinge pins 77 and 78 and fingers 105 and 106 can be moved by the toggle levers 109 and 110 in the opposite direction.

It will be noted that the other compartments of the drum 62 of the treatment appliance 60 shown in FIG. 8 comprise doors and locking systems for these doors which are identical to those shown in FIG. 8.

We shall now describe how the treatment appliance 60 shown in FIG. 8 works. In the position shown the doors are closed and the drum 62 can rotate relative to the tank 61, with the door 67 being in the position for opening, however.

When it is required to open a compartment of the drum 62, and in particular the compartment associated with the door 67, the drum 62 is rotated until the hinge pins 77 and 78 are lined up with the plungers 83 and 84, the sleeve couplings 88 and 89 and the plungers 96 and 97. The cylinder 88 is actuated and the plungers 83 and 84 move towards the hinge pins 77 and 78 and make them slide longitudinally from their "in" position corresponding to the one shown in FIG. 8 to their "out" position in which their square ends 94 and 95 enters the square ends 92 and 94 of holes 90 and 91 in the sleeves 88 and 89. In conjunction with this, fingers 103 and 104 in the closed position, said locking means being actuated to lock the said flap in the closed position when the said hinge pin is slid in the said second direction and to release the said flap when the hinge pin is slid in the said first direction, said means of rotation and the said hinge pin, when they are engaged, forming the said means of fixing the drum to the tank in rotation.

8. The appliance according to claim 7, characterized by the fact that the said door comprises a second flap which can also be opened through the said tank opening and which is mounted on the other longitudinal edge of the opening of the said compartment by means of another longitudinal hinge the pin of which is fixed in rotation to this second flap, another first longitudinal plunger installed on the tank on the said first side of the drum enables the said other hinge pin to be slid longitudinally and in the said first direction from an "in" position to an "out" position in which it engages with another means of rotation installed on the said tank on the said second side of the drum, this means of rotation enabling the said other hinge pin to be rotated to open or close the said second flap, another second longitudinal plunger installed on the said tank on the said second side of the drum enabling the said other hinge pin to be slid longitudinally and in the said second direction from its "out" position to its "in" position, another locking means enabling the said second flap to be held in the closed position, this other locking means being operated to lock the said second flap in the closed position when the said second pin slides in the said second direction and to release the said second flap when the said other hinge pin slides in the said first direction, said other means of rotation and the said other hinge pin also forming, when they engage, the said means of fixing the drum in rotation to the tank.

9. The appliance according to claim 7, characterized by the fact that at least one said means of rotation comprises a rotary coupling sleeve with a longitudinal hole for receiving said hinge pin, said hole and said hinge pin having corresponding cross-sections which enable the sleeve and the hinge pin to be fixed together in rotation, a rotary drive means enabling said sleeve to be rotated in one direction or the other to open or close the said flap, said second plunger entering an opposite end of said sleeve hole to act on the end of the said hinge pin in the said second direction.

10. The appliance according to claim 8, characterized by the fact that the sleeve of the said means of rotation and the sleeve of the said other means of rotation each comprise a radial arm, said drive means including a cylinder having a rod connected to the end of the arm of one sleeve, said body being connected to the end of the arm of the other sleeve so that, when this cylinder is actuated, the sleeve of the said means of rotation and the sleeve of the said other means of rotation rotate in opposite directions in order to jointly open or close the first flap and the second flap of the said door.

11. The appliance according to claim 8, characterized by the fact that the said first plunger and the said other first plunger and the said second plunger and said other second plunger are linked by a cross member and another cross member, with a cylinder mounted on the tank being combined with each cross member so as to act on this cross member in order to move the said linked plungers longitudinally in one direction or the other.

12. The appliance according to claim 7, characterized by the fact that the said locking means comprises a first lever which is mounted in a toggle system on the said drum said first lever having one end which is fixed in translation to the said hinge pin and another end which carries or is fixed to a first locking finger which is engagable with the transverse edge of the said flap located on the side of the drum corresponding to said first plunger so as to lock it, a second lever fixed to a second locking finger which can engage with the transverse edge of the said flap located on the side of the drum corresponding to said second plunger so as to lock it, in such a manner that, when the said hinge pin is moved in the said first direction, the said fingers move away and release the said flap and, when the said hinge pin is moved in the said second direction, the said fingers move in and lock the said flap by engaging respectively with the opposite side edges of the said flap.

13. The appliance according to claim 12 having two said flaps and two said hinge pins, said second lever extending transversely and has its opposite end fixed in translation to the said two hinge pins, with this transverse lever carrying two fingers capable of engaging respectively with the transverse edge of the said two flaps located on the side of the drum where the said second plunger is located.

14. The appliance according to claim 3, characterized by the fact that the said flap extends, in the open position, roughly along planes passing through the drum centre line.

15. The appliance according to claim 1, characterized by the fact that the said tank is cylindrical in its overall shape.

16. The appliance according to claim 1, characterized by the fact that the said drive means acting on the tank to rotate it round the drum shaft comprises at least one cylinder placed in a radial plane and acting on an end wall of the tank.

17. The appliance according to claim 1, characterized by the fact that the said tank is mounted at each of its axial ends on a support through a sliding bearing, with a packing type seal providing the sealed connection between the tank and the drum shaft, and with the said support being adjustable so that the tank is centred on the drum centre line.

* * * * *